United States Patent [19]

Krull

[11] 4,022,311

[45] May 10, 1977

[54] ELECTRODYNAMIC ACTUATOR

[75] Inventor: Felix B. Krull, Leitershofen near Augsburg, Germany

[73] Assignee: NCR Corporation, Dayton, Ohio

[22] Filed: Nov. 19, 1975

[21] Appl. No.: 633,316

[52] U.S. Cl. ..... 197/1 R; 101/93.33; 101/93.34

[51] Int. Cl.[2] ..... B41J 3/04

[58] Field of Search ..... 197/1 R; 101/93.28, 101/93.29, 93.32–93.34; 178/23 R, 26, 30

[56] References Cited

UNITED STATES PATENTS

| | | | |
|---|---|---|---|
| 3,049,990 | 8/1962 | Brown et al. | 101/93.33 |
| 3,279,362 | 10/1966 | Helms | 101/93.34 X |
| 3,416,442 | 12/1968 | Brown et al. | 101/93.33 |
| 3,830,976 | 8/1974 | Taylor | 178/30 |

FOREIGN PATENTS OR APPLICATIONS

| | | | |
|---|---|---|---|
| 2,406,132 | 8/1974 | Germany | 197/1 R |

*Primary Examiner*—Ralph T. Rader
*Attorney, Agent, or Firm*—J. T. Cavender; Albert L. Sessler, Jr.; Elmer Wargo

[57] ABSTRACT

An actuator, which in a preferred embodiment, is shown in a wire matrix printer, and includes a magnetic structure having a support member associated therewith. When used in a wire matrix printer, the actuator includes a plurality of output members (in disc form) mounted on said support member for movement between operative and inoperative positions. Each output member has a coil structure thereon, and when the coil structure is energized, the associated output member is moved to the operative position where a printing element on the output member is brought into printing relationship with a platen of the printer.

2 Claims, 9 Drawing Figures

ELECTRODYNAMIC ACTUATOR

BACKGROUND OF THE INVENTION

This invention relates to an electrodynamic actuator, which in a preferred embodiment, can be used in a wire matrix printer.

A wire matrix printer forms visual characters by impacting groups of elongated printing elements against a platen with a record medium and generally an inked ribbon positioned between the platen and the printing elements. In some of the printers, an entire character is printed at one time, requiring 35 printing elements and actuators to print a 5×7 matrix character, for example. In other printers, 7 or 9 printing elements, for example, may be arranged in a line adjacent to the platen, and a character is formed by energizing selected ones of the printing elements as the line of printing elements is moved in a direction which is perpendicular to the line of printing elements. The following list of U.S. Pat. Nos. is representative of various wire matrix printers: 3,333,667, 3,833,105, 3,217,640, 3,842,955, and 3,795,298, 3,889,793.

Each of the above named patents discloses a wire matrix printer which utilizes long wire printing elements which need to be supported, and each requires a separate magnet for each of its associated actuators.

In contrast with the above, the actuator of the present invention, when utilized as a printer, utilizes a single magnetic means for a plurality of printing elements. In the present invention, no expensive print wire guides to support the printing elements are necessary and no special spring elements are needed to retain each of the printing elements in an inoperative position. The printing elements are very short and each is mounted on the periphery of a self supporting disc and impacts against a platen as a result of a tangential force applied to the associated disc. The actuator of the present invention is also economical to manufacture, due to its very simple construction.

SUMMARY OF THE INVENTION

This invention relates to an actuator which includes a magnetic means having a support means associated therewith, and with at least one output means mounted on said support means for movement between operative and inoperative positions thereon. Each of the output means has a coil means thereon, which when energized causes the associated output means to move from said inoperative position to said operative position. In a preferred embodiment, the actuator of this invention is depicted as a wire matrix printer.

BRIEF DESCRIPTION OF THE DRAWINGS

The previously enumerated advantages and features of this invention will become more readily understood in connection with the following detailed description and drawings in which.

DETAILED DESCRIPTION OF THE INVENTION

Figure 1:
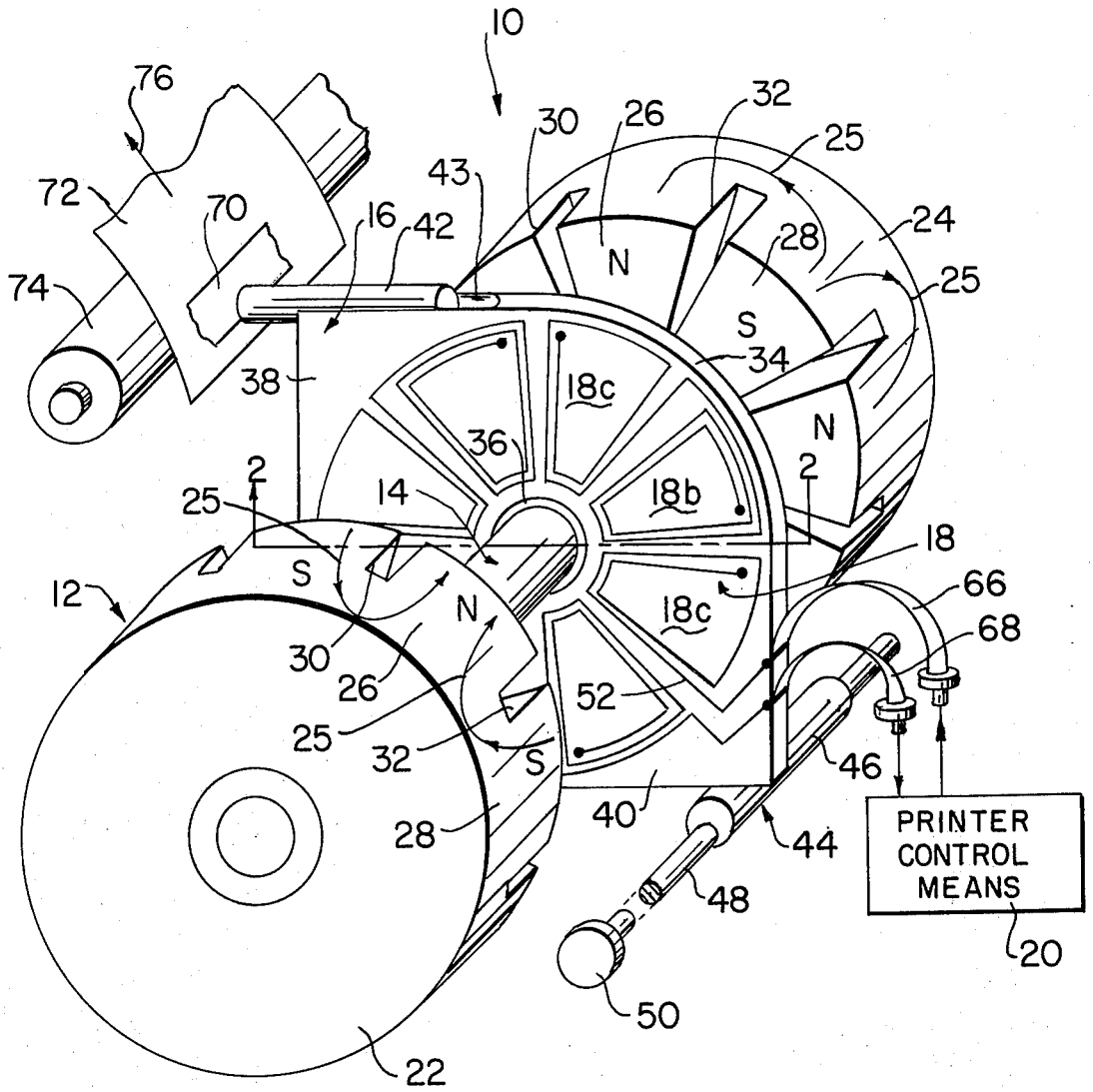
FIG. 1 is a general perspective view of an actuator made according to the principles of this invention, which in its preferred form, is shown as a wire matrix printer having a magnetic means and at least one output means mounted for movement between operative and inoperative positions on a support means.

FIG. 1 is a diagrammatic representation of an actuator designated generally as 10 and made according to the principles of this invention. While the actuator 10 may be used in a variety of applications, the preferred embodiment selected to portray this invention is an embodiment which may be used in a wire matrix printer.

The actuator 10 (FIG. 1) includes a magnetic means 12, a support means 14 operatively associated with the magnetic means 12, and at least one output means 16 mounted on the support means 14 for movement between operative and inoperative positions thereon. The output means 16 has a coil means 18 thereon which cooperates with the magnetic means 12 to move the output means 16 between the operative and inoperative positions whenever the coil means 18 is energized by an associated printer control means 20.

The magnetic means 12 (FIG. 1) includes first and second magnets 22 and 24 which may be of the permanent magnet type, and which magnets are spaced apart to provide a working air gap therebetween. The first magnet 22, in one embodiment, has eight magnetic poles thereon like 26, 28 which are equally spaced around the perimeter thereof. The first magnet 22 has radially aligned slots 30, 32 shown therein simply to better illustrate the locations of the poles like 26, 28; however, in an actual embodiment, slots 30, 32 would not be present. The second magent 24 is identical to the first magent 22 and is also shown with the poles 26, 28 and associated slots 30, 32. The first and second magnets 22, 24 are fixed on the support means 14 in spaced parallel relationship to each other and are aligned in an axial direction so that a north pole 26 of the first magnet 22 is opposite a south pole 28 on the second magnet 24. The magnetic return path of two adjacent poles is shown as lines 25 in FIG. 1. The space or air gap between the first and second magnets 22, 24 is dependent upon the number of output means like 16 located therebetween. Depending upon a particular application, the number of output means 16 mounted on the support means 14 may be three, four, five, seven, or nine when used as a wire matrix printer; however, for ease of illustration, only one output means 16 is shown on the support means 14. The support means 14 is made of non-ferrous or plastic material and is used as an axle for rotatably supporting the output means 16; a suitable plastic material like nylon may be used for the support means 14 to provide a low friction bearing for the output means 16.

The output means 16 (FIG. 1) is generally comprised of a disc-shaped member or disc 34, which in the preferred embodiment, is made of a synthetic plastic material which may be reinforced with fiberglass, and the disc 34 is pivotally mounted on the support means by a bearing 36 which is made of a low friction plastic material like nylon. At one portion of the periphery of the disc 34 a first shoulder 38 is formed thereon and at about 180° therefrom, a second shoulder 40 is formed thereon. The output means 16 has an output member 42 formed on the shoulder 38, which output member 42 may be a printing element like a print wire for the embodiment shown. The output member 42 is positioned along a tangent line to disc 34. In the embodiment shown in FIG. 1, the output member 42 may be a steel print wire which is shaped to print a dot when brought into operative engagement with the platen of a printer, and is secured to a mating recess 43 in the first shoulder 38 by a suitable adhesive like epoxy cement. The second shoulder 40 abuts against an adjustable stop means 44 which includes a cylindrical member 46 which is fixedly mounted off-center on a shaft 48 having a knob 50 thereon. The shaft 48 is rotatably supported in a suitable frame means like the frame means 52 shown in FIG. 5. The second shoulder 40 is biased into engagement with the cylinder 46 when in the inoperative position shown in FIG. 1 by means to be later described herein.

The coil means 18 (FIG. 1) which is located on the output means 16 is constructed in the following manner. The coil means 18 may be produced by printed circuit technology and may be located in suitable recesses in the disc 34 (FIG. 2) whenever it is desirable to produce a thin disc 34, as for example when the actuator 10 is used as a wire matrix printer. The particular configuration of the coil means 18 is best shown in relation to the schematic diagrams shown in FIGS. 3 and 4.

Figure 2:
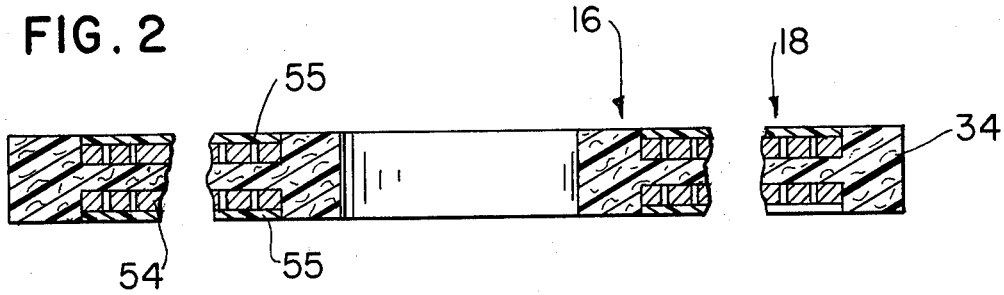
FIG. 2 is a cross-sectional view, taken along the line 2—2 of FIG. 1, to show additional details of the output means and a coil means thereon.
Figure 3:
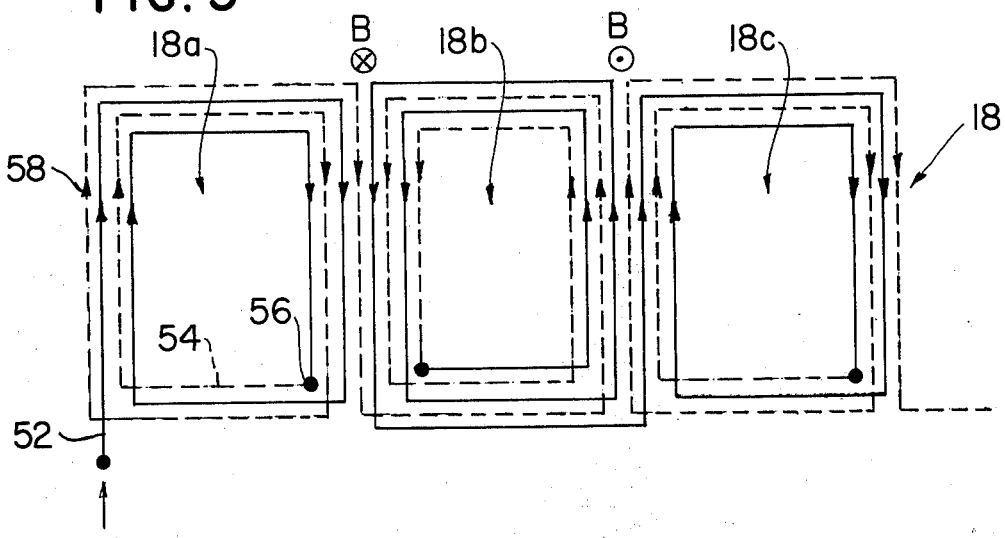
FIG. 3 is a schematic diagram of one embodiment of the coil means.
Figure 3A:
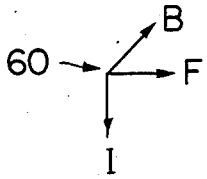
FIG. 3A is a vector diagram associated with the coil means shown in FIGS. 3 and 4.
Figure 3B:
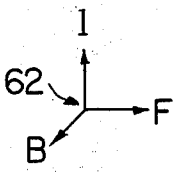
FIG. 3B is a vector diagram associated with the coil means shown in FIGS. 3 and 4.

The solid lines like 52 of the coil means 18 in FIG. 3 are conductors which are located on one side of the disc 34 and the dashed lines like 54 are conductors which are located on the opposite side of the disc 34 (as shown in FIG. 2) with the dots like 56 representing electrical contact pass-through-holes in the disc 34. The individual coils like 18*a*, 18*b*, etc. may be covered by an insulating layer of plastic 55 as shown in FIG. 2, and the sides of magnets 22, 24 facing each other in FIG. 1 are also covered by a layer of insulating plastic (not shown) to also reduce friction between the adjacent individual output means 16 and the face of the associated magnet. The arrows like 58 represent the current flow through the coil means 18 and the vector diagrams 60 and 62 (FIGS. 3A, 3B) associated with FIG. 3 show the direction of force (F) resulting from a current flow (I) and magnetic field (B). The lines 52, like 52 for example, represent conductors which are positioned radially when incorporated on the disc 56 shown in FIG. 1. The configuration of the coil means 18 is such that individual coils 18*a*, 18*b* and 18*c*, for example, are formed by the wiring pattern shown in FIG. 3. From the wiring pattern shown in FIG. 3, it is apparent that the coils 18*a*, 18*b*, 18*c* etc., are series connected and the direction of current flow reverses from pole pitch to pole pitch. The number of coils like 18*a*, 18*b* on the disc 34 is equal to the number of magnetic poles on the first and second magnets 22, 24, and when the disc 34 is in the inoperative position shown in FIG. 1, individual coils like 18*a*, 18*b* are displaced by half a pole pitch relative to the poles on the first and second magnets 22, 24. The coil means 18 is connected to an energizing means like the printer control means 20 (which may be conventional) by flexible electrical conductors 66 and 68.

The operation of the actuator 10 shown in FIG. 1 is as follows. When the output means 16 is to be actuated, the associated coil means 18 is conventionally energized by the printer conrol means 20, causing a current to travel through the series connected coils 18*a*, 18*b*, 18*c*, etc., thereby reacting with the magnetic poles on the first and second magnets 22, 24 to cause the disc 34 to be rotated in a counterclockwise direction (as viewed in FIG. 1) to the operative position in which the output member 42 impacts against a ribbon 70 and record medium 72 located on a platen 74. The forces generated by the reaction just described are aligned tangentially relative to the disc 34 in accordance with Biot-Savart's law. Because the direction of current in the coils 18*a*, 18*b*, 18*c*, etc., and the direction of the magnetic field between opposed poles on the magnets 22, 24 are both changing from pole pitch to pole pitch, the resultant individual forces in the tangential direction relative to disc 34 are in additive relation to one another, and consequently, cause a strong moment of force around the axis of the support means 14. This moment of force provides an accelerated rotational movement of disc 34 enabling the output member 42 or print wire to impact against the platen 74. The rotational movement of disc 34 is slight when the actuator 10 is used as a printer, as the stroke of the output member 42 or print wire need be only about 1 mm. in length. While only one output mans 16 is shown in the actuator 10, several such actuators may be mounted in side by side relation on the support means 14 to comprise a wire matrix printer. In the embodiment shown in FIG. 1, the record medium 72 is moved in the direction of arrow 76 to effect a completion of a character by wire matrix printing techniques, although the more usual form of wire matrix printing is effected by the embodiment shown in FIG. 7.

After the output member 42 (FIG. 1) impacts against the platen 74, it is returned to the inoperative position shown in FIG. 1 by reversing the direction of current flow through the coil means 18 via the printer control means 20 and maintaining a small residual current therein so as to maintain the output means 16 in the inoperative position shown in which the second shoulder 40 abuts against the adjustable stop means 44.

Some of the features of the actuator 10 when used as a wire matrix printer are that the print wires 42 can be kept extremely short and do not require any guides to align them at the platen 74, and no special springs are required to return and keep the output means 16 in the inoperative position. Also the disc 34 of the output means 16 offers a maximum of rigidity in the direction of printing.

Figure 5:
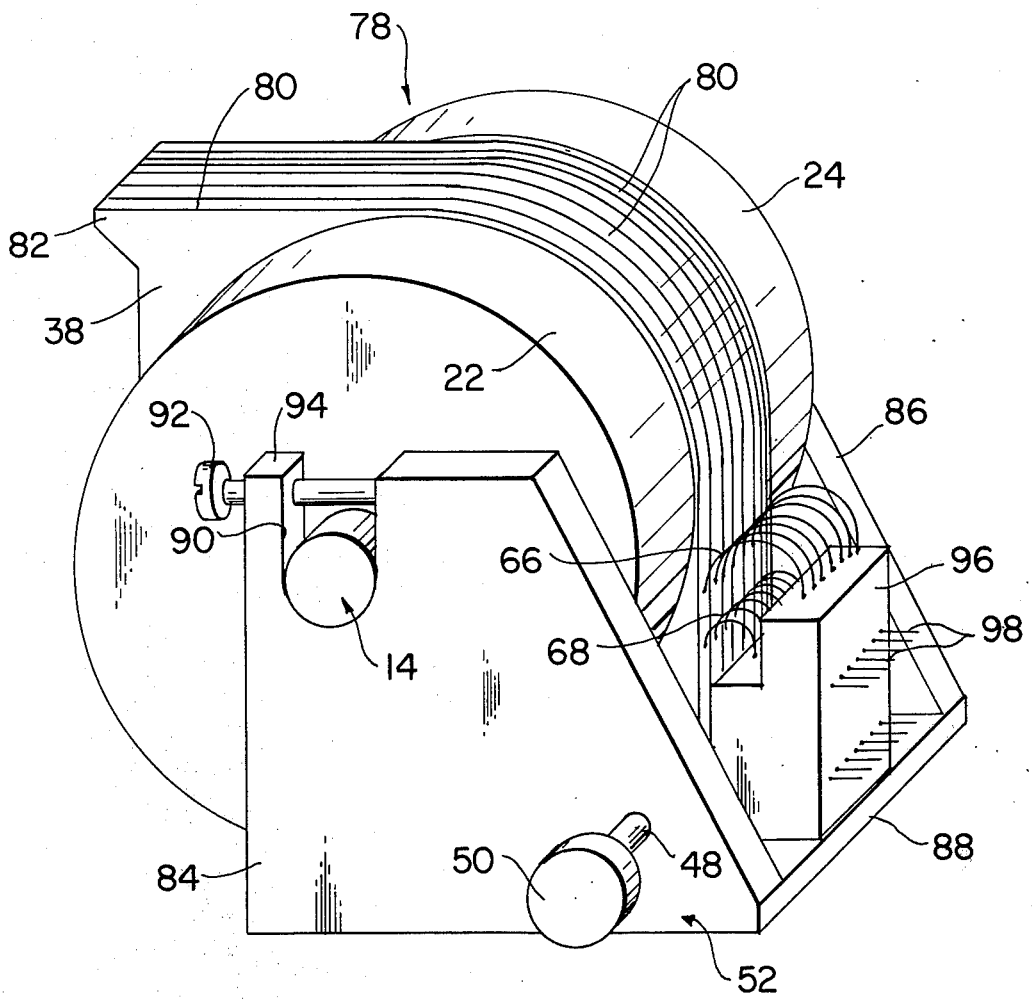
FIG. 5 is a general perspective view of a second embodiment of an actuator of this invention to show how a printing element may be integrally formed on the output means.

FIG. 5 shows a second embodiment of the actuator of this invention which is designated generally as 78 which shows a plurality of output means 80, mounted on the support means 14. The actuator 78 is idential to the actuator 10 shown in FIG. 1 except as will be described herein; therefore; like numerals will be used to identify similar parts. The only difference in the actuator 78 compared to the actuator 10 is that each output means 80 has the printing element formed directly on the first shoulder 38 thereof. The shoulder 38 is shaped to form a printing element 82 thereon, and thereafter, it is conventionally plated to form a layer (not shown) of chromium thereover to harden it to make it suitable for printing. The actuator 78 is supported in side frames 84, 86 which are positioned in spaced parallel relationship to each other and are joind by a joining plate 88. The support means 14 is fixed in an elongated slot 90 in each of the side frames 84, 86 by a fastener 92 which compresses an extension 94 of the side frames 84, 86 against the support means 14. The flexible conductors 66, 68 are offset relative to each other to avoid contact with one another and are connected to a conventional terminal block 96. The terminal block 96 with the connecting pins 98 thereon is operatively connected to the printer control means 20 to conventionally, selectively, energize the output means 80 in accordance with the character to be printed. The terminal block 96 in cooperation with the second shoulders 40 (FIG. 1) of the output means 80 can be used to limit the movement of the output means 80 towards the operative position by spacing the block 96 an appropriate distance from the shoulders 40.

Figure 7:
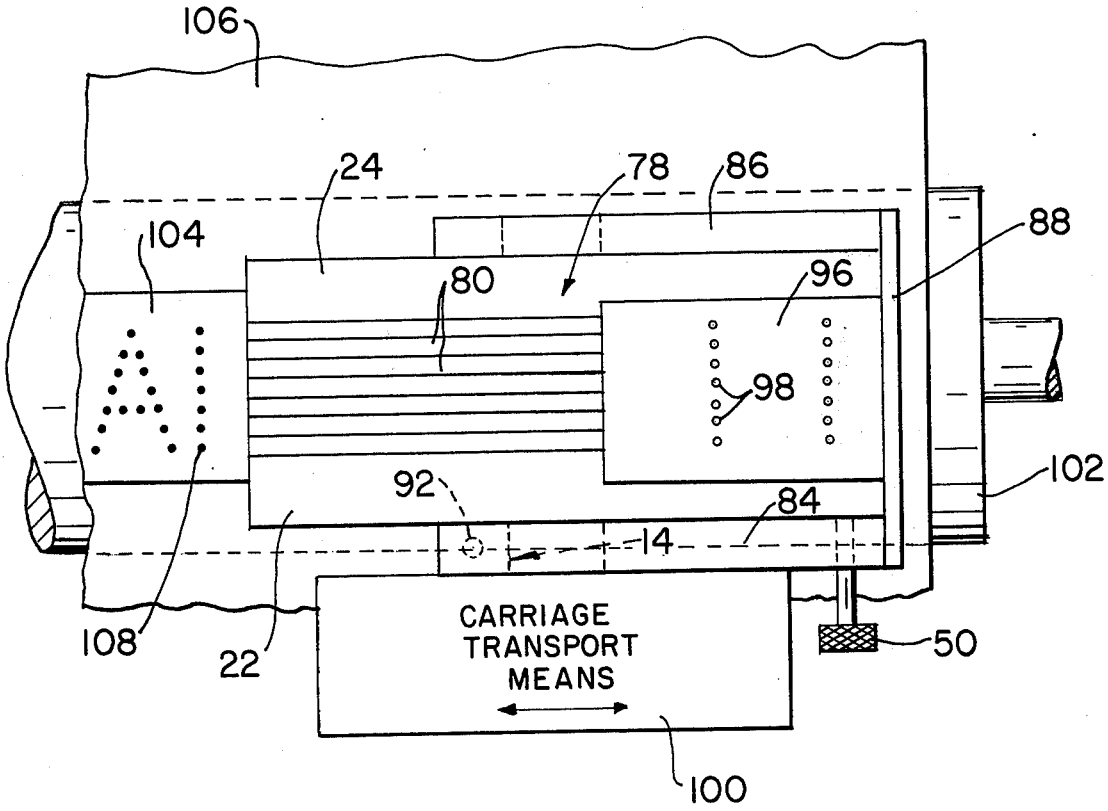
FIG. 7 is a front view in elevation showing how the actuator of this invention may be used in a typical wire matrix printing environment.

FIG. 7 shows the actuator 78 as used in a printer environment. The actuator 78 is mounted on a conventional carriage transport means 100 to traverse the actuator 78 along a platen 102. The individual output means 80 (discs) are brought into operative engagement with an inked ribbon 104 and record medium 106 on the platen 102 to form the character "A" for example. The individual printing elements 82 are arranged to print along a line 108 which is perpendicular to the direction of travel of the actuator 78 along the platen 102. One advantage of the actuator 78 is that the last character printed is visible as the actuator traverses along the platen 102.

Figure 6:
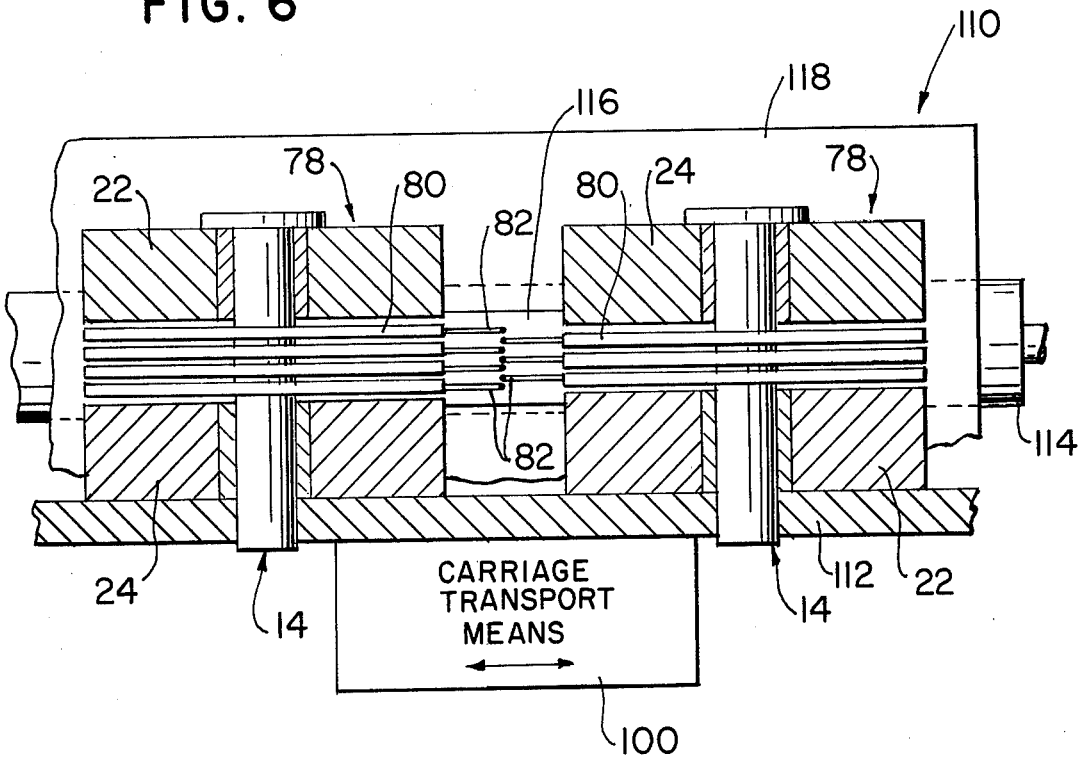
FIG. 6 is yet another embodiment of an actuator of this invention to show how the output means thereof may be interleaved to provide for compactness when a thicker output means is employed.

FIG. 6 shows yet another embodiment of the actuator of this invention which is designated generally as 110 and is shown in diagrammatic form. The actuator 110 is comprised of two actuators like 78, for example, which are positioned on a common supporting plate 112 and are mounted on a conventional carriage transport means 100 to enable the actuator 110 to be moved along a platen 114. Each actuator 78 is positioned so that the printing elements 82 of each actuator can be interleaved to form a line of printing on the platen 114, with 4 output means 80 being shown for the actuator 78 on the left and with 3 output means 80 being shown for the actuator 78 being located on the right side of FIG. 6. The individual actuators 78 (FIG. 6) are energized by the printer control means 20 as previously described and brought into printing relationship with an inked ribbon 116 and a record medium 118.

An advantage of the actuator 110 shown in FIG. 6 is that the individual output means 80 thereof may be made thicker for more strength (if desired) and yet have the associated printing elements 82 be compactly arranged in a print line to meet existing printing formats; however, the last few characters printed are obscured in this embodiment.

Figure 4:
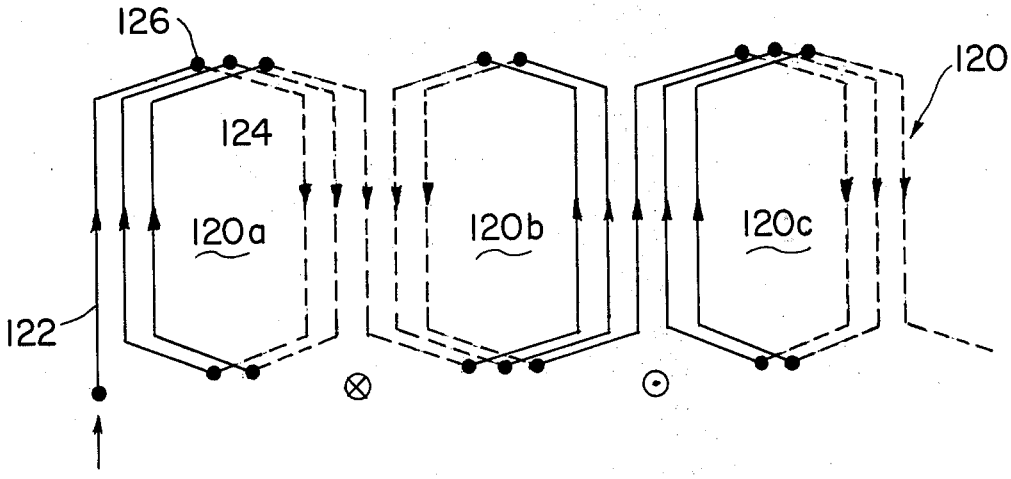
FIG. 4 is a schematic diagram of a second embodiment of the coil means.

FIG. 4 shows another embodiment of the coil means designated generally as 120 which may be employed in the various actuators shown herein. The coil means 120 is made up of conductors which are located on one side of the support means 14 (as shown in FIG. 1 for example) and are represented by solid lines 122, and conductors which are located on the opposite side of the support means 14 and are represented by dashed lines 124, with the dots like 126 representing conducting, pass-through holes. The coil means 120 is comprised of a plurality of coils like 120*a*, 120*b*, 120*c* etc., which are analogous to the oils 18*a*, 18*b*, 18*c* etc. of coil means 18. The individual windings of each coil like 120*a* are arranged in a laterally displaced manner whereby half of a complete turn of the coil is on one side of the output means 16 and the remaining half turn is located on the opposite side of the output means 16. The coil means 120 has the disadvantage that it requires more space to complete an individual coil than the coil means 18.

Another feature of the present invention is that the strokes of all the output means like 16 shown in FIG. 1, for example, may be simultaneously adjusted by simply rotating the knob 50 to a desired position where it is frictionally retained until readjusted.

What is claimed is:

1. An actuator comprising:

first and second magnet means being of the multipole, permanent-magnet type and being spaced apart in parallel relationship to each other;

a non-ferrous axle interconnecting said first and second magnet means;

a plurality of output means mounted on said axle between said first and second magnet means for rotating movement between inoperative and operative positions thereon, with each said output means being disc-shaped and having a plurality of coils thereon;

said first and second magnet means having an equal number of poles and being aligned in an axial direction along said axle so that a north pole of the first magnet means is opposite a south pole of the second magnet means, and vice versa;

each said output means having an output member thereon and a plurality of coils thereon, with one such coil being provided for each said pole of said first and second magnet means;

said plurality of coils being radially arranged on the associated said output means so that each said coil is displaced from the associated said poles by half a pole pitch when said output means is in said inoperative position, and each said coil has a plurality of turns with one half of the turns thereof being located on one side of the output means and the remaining half of the turns of said coil being located on the opposite side of the associated said output means, and with the plurality of coils for the associated said output means being series connected with one another; and energizing means for selectively energizing said plurality of coils on said plurality of output means to move the associated said output means from said inoperative to said operative position and to return it to said inoperative position.

2. The actuator as claimed in claim 1 in which said energizing means includes control means for energizing selected ones of said output means in conformance with a predetermined pattern, and each said output member is a printing element.

* * * * *